United States Patent [19]

Ohle

[11] 4,307,888

[45] Dec. 29, 1981

[54] SOCCER KICKING TRAINER

[76] Inventor: Robert D. Ohle, 1961 S. Knox Ct., Denver, Colo. 80219

[21] Appl. No.: 152,988

[22] Filed: May 27, 1980

[51] Int. Cl.[3] ..... A63B 69/00; A63B 43/00

[52] U.S. Cl. ..... 273/413; 273/58 C

[58] Field of Search ..... 273/411, 413, 58 C

[56] References Cited

U.S. PATENT DOCUMENTS

| | | | |
|---|---|---|---|
| 1,620,742 | 3/1927 | Spafford | 273/413 |
| 3,454,275 | 7/1969 | Pontone | 273/58 C X |
| 3,790,171 | 2/1974 | Anderson | 273/413 |
| 4,147,353 | 4/1979 | Moore | 273/413 |
| 4,158,458 | 6/1979 | Gomez | 273/413 |

*Primary Examiner*—William H. Grieb

*Attorney, Agent, or Firm*—Jack C. Sloan

[57] ABSTRACT

A soccer kicking trainer comprising an elongated mounting arm having a loop at one end for seating a soccer ball attached to the loop by elastic bands and having at the other end an extended elbow extending vertically downward for inserting loosely and pivotally in holding eyes which are attached to a vertical mounting post. The mounting arm is equipped with a biasing element for returning the ball to its original position after it has been kicked.

9 Claims, 8 Drawing Figures

SOCCER KICKING TRAINER

BACKGROUND OF THE INVENTION

This invention relates to an apparatus for soccer kicking practice, and more particularly to a soccer kicking trainer device whereby a soccer ball will automatically return to the kicker without the necessity of retrieving the ball.

In the practice of kicking in the game of soccer it is desirable for a kicker to be able to kick the ball without the necessity of having some other party retrieve the ball or having to retrieve the ball himself. Furthermore, it is desirable to be able to perform kicking practice in a somewhat confined space indoors during inclement weather. A soccer kicking trainer that accomplishes these objectives should be capable of being set up and taken down quickly and easily and take a minimum of space for transportation and storage and most importantly should also be capable of being adjusted to accommodate kickers of different heights. Lastly, the device should be comprised of elements combined in such a manner that they will not entangle the kicker's foot.

SUMMARY OF THE INVENTION

The above objects are accomplished in this invention by providing an elongated mounting arm extending in a substantially horizontal plane. At one end of the mounting arm a loop is fashioned in a substantially vertical plane so that a soccer ball will tend to be seated in the opening of the loop if the ball is held snugly against the loop by elastic bands. Preferably the loop will have an opening so the circular elastic bands can be inserted into and around the loop without having to cut the elastic band in order to tie knots around the body of the loop. Such an arrangement helps maintain the physical strength and integrity of the elastic band and allows the soccer ball to be quickly and easily attached to and detached from the loop. Furthermore, the entire mounting arm or any part of it can be covered with a soft rubber to prevent injuries to the kicker.

At the other end of the mounting arm an elongated elbow is fashioned by bending the mounting arm about 90° downward so that the elongated elbow, the mounting arm and the citrcular opening of the loop are in substantially the same vertical plane. The elongated elbow is inserted into one or more holding eyes which are affixed to a vertical mounting post. The holding eyes are positioned in a vertical line in a horizontal plane so that the eye(s) face upward to receive the elongated elbow which passes through the eyes which fit loosely around the elongated elbow so that the elbow can pivot in the eye(s). Also at the other end of the mounting arm within about four inches of the elbow, a biasing means such as hard rubber or a spring is attached to the mounting arm so that when the ball is kicked the mounting arm swings in an arc and compresses the biasing means against the vertical mounting post. Whereupon, the resilient force of the biasing means will drive the mounting arm, and hence the soccer ball back toward the kicker.

The mounting post can be of any suitable material. However, a standard 4"×4"×8' wooden post is particularly well adapted for this purpose. A vertical series of holes are drilled in the vertical mounting post for receiving the holding eyes. The ends of the holding eyes are threaded and are inserted through the holes in the mounting post. The holding eyes are secured by means of a washer and nut threaded on the end of the holding eye.

When being used outdoors, the vertical holding post can be imbedded in the ground or more preferably inserted into a post receiver piece which is imbedded into the ground or in a concrete slab in the ground. If vertical mounting post mobility is required, the post can be imbedded in a base slab of concrete which is preferably encompassed by an automobile or truck tire.

This invention is also adapted for use indoors either by means of moving the base slab indoors or more preferably by using an existing support post in the cellar or garage. If such a support does not exist or cannot be readily fashioned then an existing door can be used as the mounting post by use of a modified holding eye which has, rather than a threaded end, as previously described, a channel having sides which are preferably from 1 to 4 inches deep and a width of about 1½ inches wide mounted to the side of the eye. The channel will encompass the vertical edges of the door and be positioned by means of a screw having a broad flat contact surface which will abut against the door. The screw will extend through one of the sides of the channel.

The loop at the end of the elongated mounting arm can be from about 2 to about 8 inches in its inside diameter with about 5 inches being preferred. Preferably the loop will not form a complete circle but will have a slight opening through which the elastic bands can be inserted and then wrapped around the loop. Preferably the bands are formed into two figure 8 circles which encompass substantially opposing sides of the loop. The end circles are of course connected by the strands of the bands across the diameter of the loop in the manner of a string across a tennis racquet. The strands of the bands are then extended and the soccer ball is seated in the loop and the extended strands allowed to encompass the ball and hence tightly seat the ball against the loop. At least two such bands should encompass the ball, preferably at about 90° to each other to assure that the ball won't be kicked from between the loop and the encompassing bands.

DETAILED DESCRIPTION OF THE INVENTION

Figure 1:
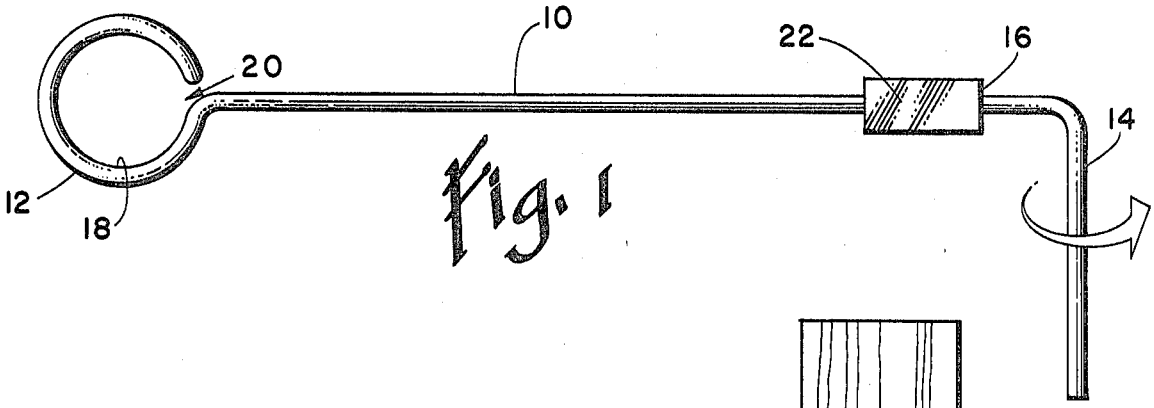
FIG. 1 is a side view of the elongated mounting arm showing at one end the loop with the open space for slipping through elastic bands. At the other end the 90° downward extended elbow is shown just to the right of the hard rubber biasing means.

Referring now to the drawings, FIG. 1 shows the elongated mounting arm 10 with a loop 12 at one end and the extended elbow 14 at the other end. A biasing means such as a hard rubber tube 6 is shown encompassing the mounting arm 10 near the elbow end of the mounting arm. The inside edge 18 of the loop 12 acts as the seat against which the soccer ball (not shown) is positioned. The loop 12 can be completely closed, but preferably it should have a gap 20 to allow elastic bands (not shown) to be wrapped around the loop 12. Preferably the mounting arm 10, the loop 12, and the extended elbow 14 should be fashioned, in one piece and in one plane, from a round metal bar preferably having a diameter of from one quarter inch to two inches. The length of the mounting arm 10 from the loop 12 to the elbow 14 is preferably from two feet to six feet. The length of the extended elbow 14 is preferably from three inches to eighteen inches. The biasing means 16 could be a spring or the hard rubber sleeve shown which is positioned near enough to the elbow end 14 of the elongated arm 10 so that the biasing means will compress against a vertical holding post (not shown) as the extended elbow 14 rotates in holding eyes (not shown). Preferably the biasing means has a shock absorbing contact surface 22 of from one to about three inches wide.

Figure 2:
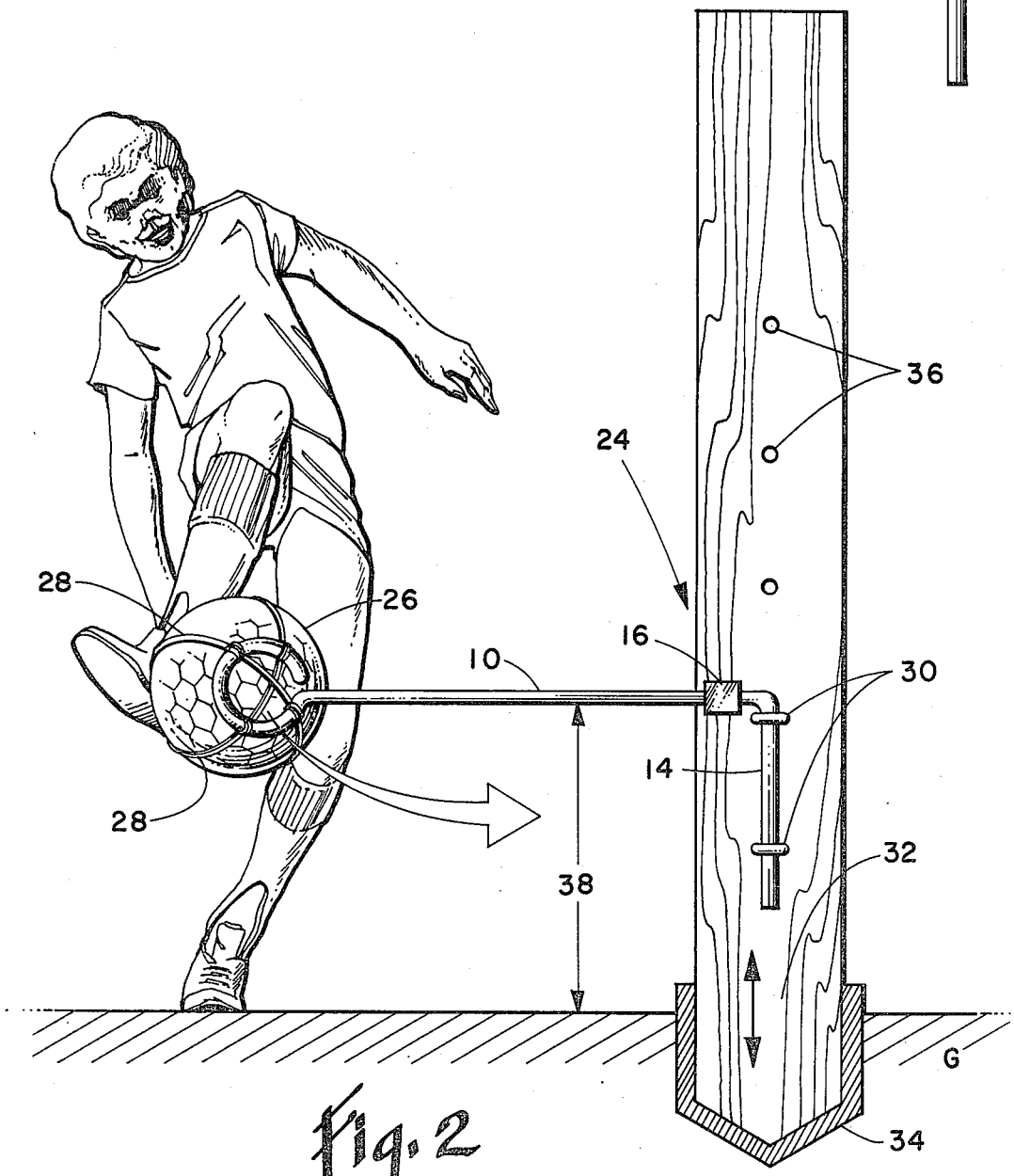
FIG. 2 is an exaggerated frontal view of the soccer kicking trainer in use, partially cut away to show the vertical mounting post inserted into a ground base receiver.

FIG. 2 shows an exaggerated view of the soccer kicking trainer 24 in use. The soccer ball 26 is shown firmly seated on the loop 12 by means of elastic bands 28 which are attached to the loop 12 and which snugly encompass the ball 26 as shown. The extended elbows 14 is shown inserted into holding eyes 30 which are attached to a vertical mountpost 32 shown affixed to the ground by means of a post holder recepticle 34 imbedded in the ground. The vertical mounting post 32 has a series of horizontal holes 36 drilled in a vertical line through which the holding eyes 30 can be adjusted to a given height 38 for the soccer ball 26. The force of the kick is absorbed by vertical mounting post 32 and the soccer ball 26 is returned to its original position by means of the resilient force of the biasing means 16.

Figure 3:
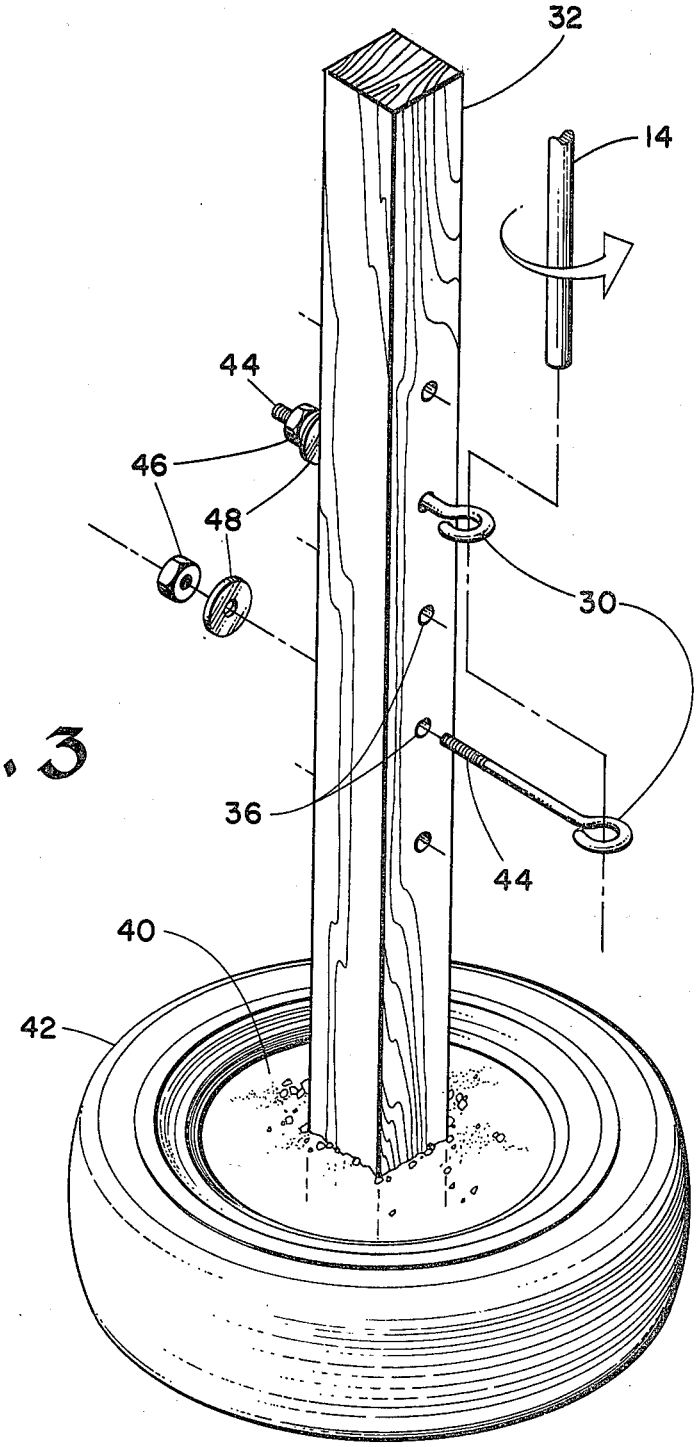
FIG. 3 is a top perspective view of the vertical mounting post set in a solid base encompassed by an automobile tire. One of the holding eyes is shown in position to receive the downward extending elbow.

FIG. 3 is a perspective view of a modified version of the soccer kicking trainer wherein the vertical mounting post 32 is mounted in a base 40 which sets above ground. Preferably the base should be encased by a rubber automobile tire. A holding eye 30 is shown inserted through the vertical mounting post 32. The holding eye has a threaded end 44 which has a threaded nut 46 and washer 48 for attaching the holding eye to the vertical mounting post 32. The extended elbow 14 is shown about to be inserted into the eye 30. The invention will work with one such eye 30 but two are preferred as shown in FIG. 2.

Figure 4:
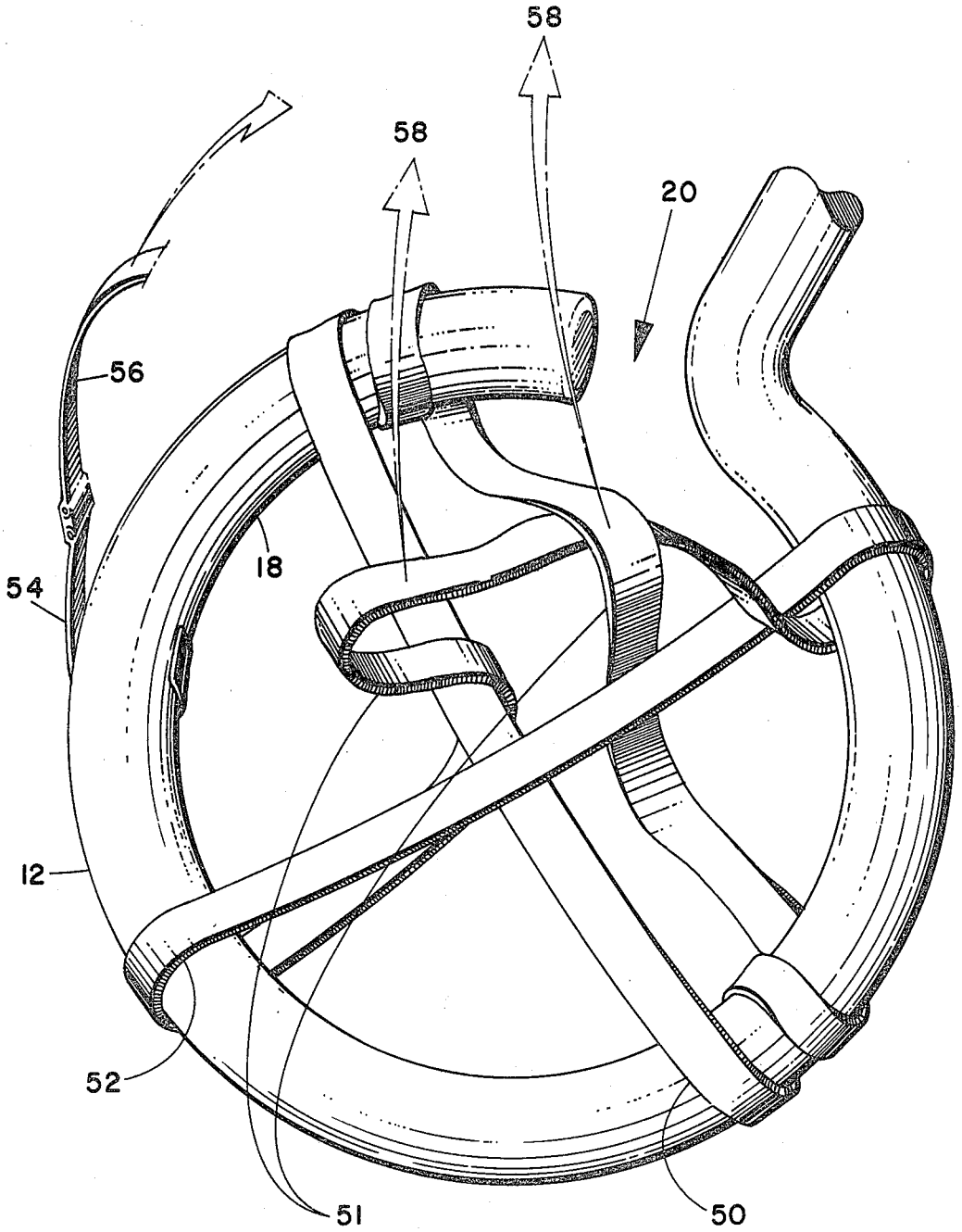
FIG. 4 is a perspective view showing various alternative ways of attaching the elastic bands to the loop.

FIG. 4 shows a perspective view of the loop 12 with the optional gap 20. Elastic bands 51 are shown wrapped around the loop in either a double wrap 50 around the loop or a single figure 8 wrap 52. If the loop 12 has an opening gap 20 the elastic bands 51 can be easily wrapped around the loop without the aid of any other device. If there is no gap 20 and the loop 12 is a complete circle then some hooking means 54 attached to an elastic band 56 will have to be used to secure the ball 26 (not shown) against the loop 12. In any event, the elastic bands 51 or 56 are pulled away from the loop 12 by manual pulling forces 58 and the ball is seated against the inside surface 18 of the loop 12 by the forces exerted on the ball by the elastic bands 51 or 56 which now encompass the ball 26 (not shown).

Figure 5:
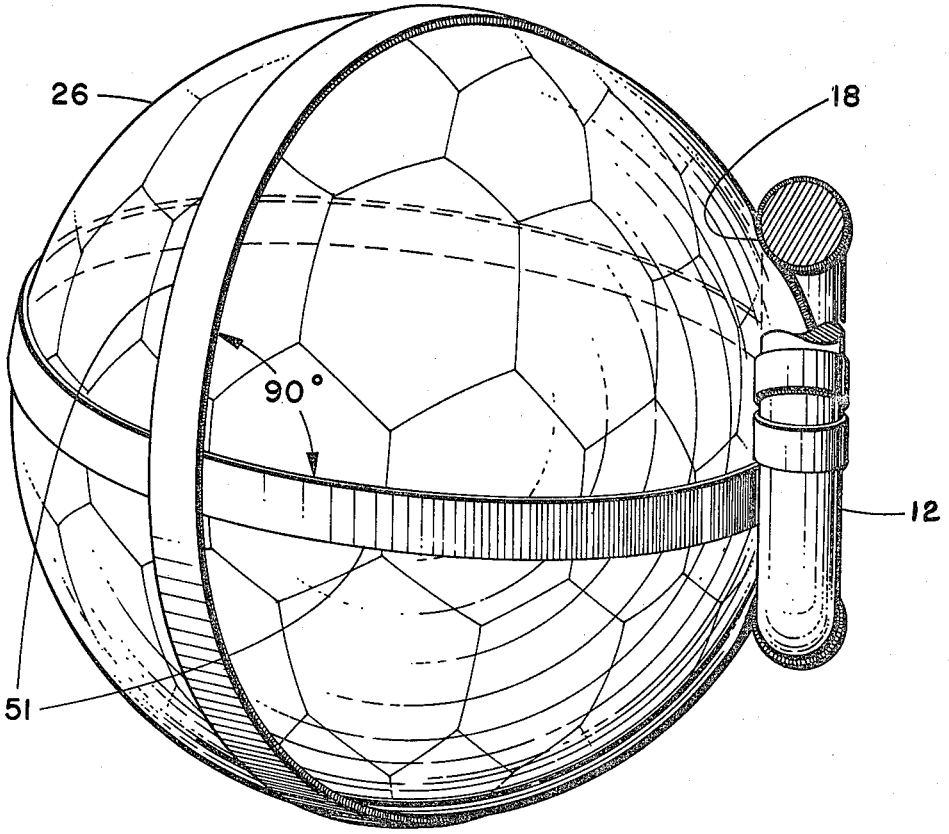
FIG. 5 is a side view showing the soccer ball seated in the loop by means of the elastic bands being wrapped around the loop and then encompassing the soccer ball.

FIG. 5 is a side view of the loop 12 showing the ball 26 seated on the inside surface of the loop 18 by means of the elastic bands 51 which snugly encompass the ball 26. Two elastic bands 51 encompassing the ball 26 at roughly 90° are the preferred arrangement as shown.

Figure 6:
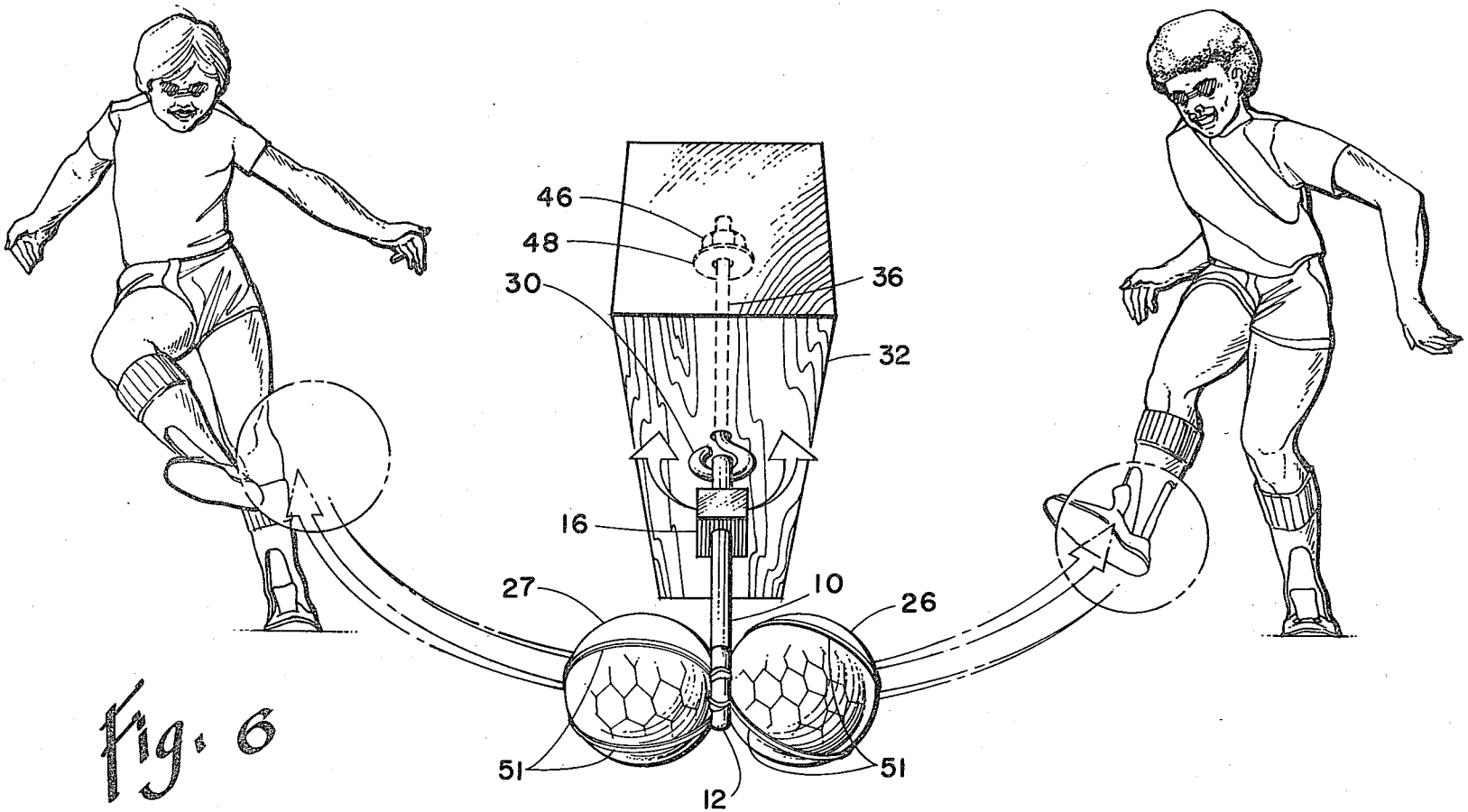
FIG. 6 is an exaggerated top view of the soccer kicking trainer with a ball on each side of the loop so that the trainer can be used by two soccer players as shown.

FIG. 6 is a top view showing a second soccer ball 27 attached opposite to the first ball 26. The attachment is in the same manner as depicted in FIG. 4. With this two ball arrangement two soccer players can practice kicking as shown. This two ball arrangement is also preferred when using the door mounted channels of FIG. 7.

Figure 7:
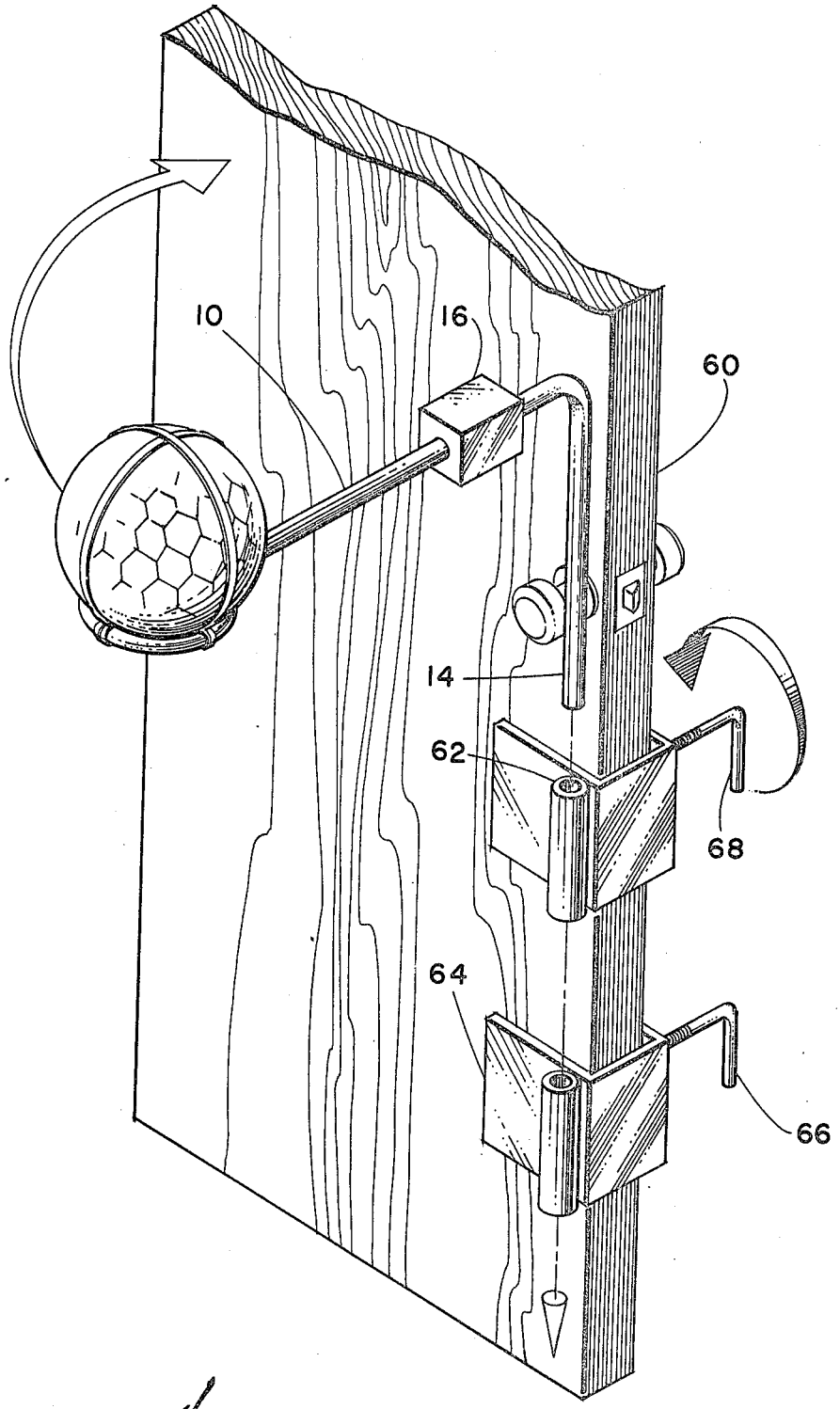
FIG. 7 is an exaggerated perspective view of the soccer kicking trainer using a door as the vertical mounting post by means of two door mounting brackets. This view shows the loop in a horizontal plane rather than in the preferred vertical plane.

FIG. 7 is a perspective view of a door 60 which is being used as the vertical mounting post by the use of one or more tube shaped holding eyes 62 affixed to a channel 64 which encompasses the door edge and which is removably attached to the door through the use of threaded lock down bolts 66 which are threaded through the side of the channel 64 and against the door by means of turning the screw handles 68. The extended elbow 14 is shown ready to be inserted into the tube shaped holding eyes 62. Again, one tube shaped holding eye 62 will act as the holder for the extended elbow 14 but two such tubes are preferred as depicted in FIG. 7. The door 60 is assumed to be in closed position. This figure shows the loop 12 in a horizontal plane. However, when the loop 12 is in a vertical plane, the two ball arrangement shown in FIG. 6 is preferred so that the loop 12 does not come in contact with either the door 60 or the kicker's foot.

Figure 8:
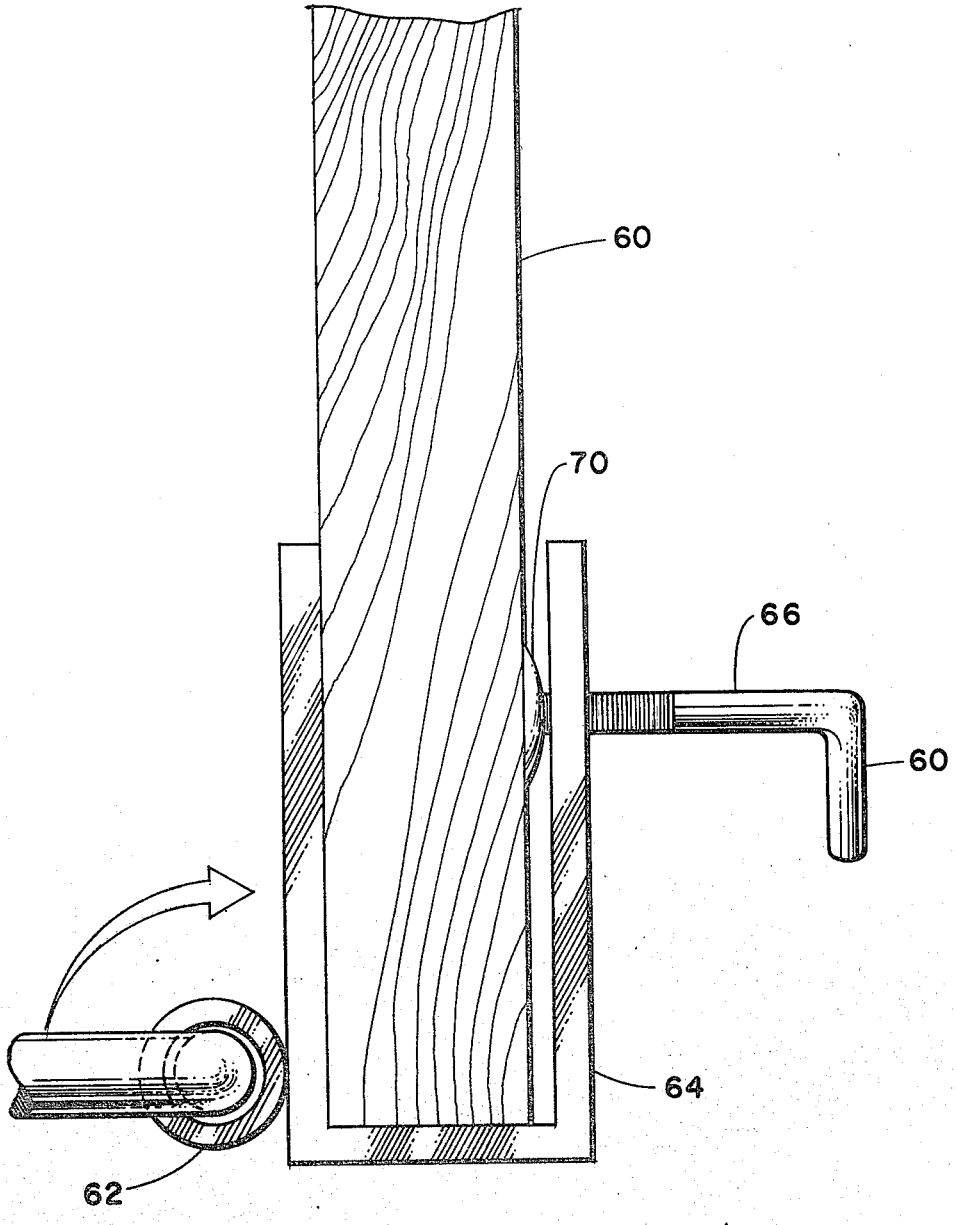
FIG. 8 is a top view of the door with a door mounting bracket in place.

FIG. 8 is a top view of the door 60 showing the channel 64 around the door 60 and showing the attached tube shaped holding eye 62. The threaded lock down bolt 66 is shown equipped with saucers 70 which are rotatable mounted to the end of the lock down bolt 66.

While there has been described a preferred form of soccer kicking trainer in accordance with the invention, it will be appreciated that many changes and modifications may be made therein without, however, departing from the essential spirit of the invention.

What is claimed is:

1. A soccer kicking trainer, comprising:

(a) an elongated mounting arm extending in an essentially horizontal plane and having at one end a loop positioned in a substantially vertical plane for seating a soccer ball, and having at the other end an elongated elbow bent and extending in a substantially downward vertical plane so that said elongated elbow can be loosely and pivotally inserted into one or more holding eyes, and wherein the elongated mounting arm has a biasing means connected near the elbow for damping the impact of the kick and returning the ball to a kicking position, (b) one or more vertically adjustable holding eyes mounted to a vertical holding post means so that the eyes are in a substantially horizontal plane for pivotally receiving the elongated elbow and thereby holding the ball at some predetermined kicking height, (c) a vertical holding post means for providing vertical support for the soccer kicking trainer and adapted for receiving and supporting the holding eyes, (d) a plurality of elastic bands for holding a soccer ball in the loop by means of the elastic bands being attached to the loop itself and encompassing the soccer ball, (e) a soccer ball positioned in the vertical planed loop by means of the elastic bands attached to the loop and encompassing the soccer ball.

2. A soccer kicking trainer as defined in claim 1 wherein the loop at the end of the mounting arm has an opening through which the elastic bands can be passed.

3. A soccer kicking trainer as defined in claim 2 wherein the elastic bands are inserted into the opening in the loop and wrapped in figure eight fashion around two opposing sides of the loop so that a first strand of the elastic bands stretches across the loop on a front side of the loop and the other strand of the elastic band stretches across a back side of the loop and wherein the first strand is pulled away from the loop and the ball inserted in the loop so that the first elastic band encompasses the ball.

4. A soccer kicking trainer as defined in claim 1 wherein the vertical holding post is mounted in a movable base.

5. A soccer kicking trainer as defined in claim 3 wherein the vertical holding post has a vertical row of holes for receiving the holding eyes.

6. A soccer kicking trainer as defined in claim 1 wherein the vertical holding post is removably mounted in a receptical imbedded in the ground.

7. A soccer kicking trainer as defined in claim 1 wherein the vertical holding post is the vertical end of a door and where each holding eye is fixedly attached to a channel which encompasses the vertical edges of the door and wherein said channel is fixed to a given elevation by means of a hold down screw passing through one side of the channel and abutting against the door.

8. A soccer kicking trainer as defined in claim 1 wherein a ball is mounted on each side of the loop.

9. A soccer kicking trainer, comprising:

(a) An elongated mounting arm extending in an essentially horizontal plane and having at one end a loop positioned in a substantially horizontal plane for seating a soccer ball, and having at the other end an elongated elbow bent and extending in a substantially downward vertical plane so that said elongated elbow can be loosely and pivotally inserted into one or more holding eyes, and wherein the elongated mounting arm has a biasing means connected near the elbow for damping the impact of the kick and returning the ball to a kicking position, (b) One or more vertically adjustable holding eyes mounted to a vertical holding post means so that the eyes are in a substantially horizontal plane for pivotally receiving the elongated elbow and thereby holding the ball at some predetermined kicking height, (c) A vertical holding post means for providing vertical support for the soccer kicking trainer and adapted for receiving and supporting the holding eyes, (d) A plurality of elastic bands for holding a soccer ball in the loop by means of the elastic bands being attached to the loop itself and encompassing the soccer ball, (e) A soccer ball positioned in the vertical planed loop by means of the elastic bands attached to the loop and encompassing the soccer ball.

* * * * *